US009093790B2

(12) United States Patent
Ohyama

(10) Patent No.: US 9,093,790 B2
(45) Date of Patent: Jul. 28, 2015

(54) CONNECTOR DEVICE

(71) Applicant: YAZAKI CORPORATION, Minato-ku, Tokyo (JP)

(72) Inventor: Kouichi Ohyama, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 40 days.

(21) Appl. No.: 14/031,338

(22) Filed: Sep. 19, 2013

(65) Prior Publication Data

US 2014/0017932 A1 Jan. 16, 2014

Related U.S. Application Data

(63) Continuation of application No. PCT/JP2012/057009, filed on Mar. 19, 2012.

(30) Foreign Application Priority Data

Mar. 22, 2011 (JP) ..... 2011-062653

(51) Int. Cl.

| | |
|---|---|
| ***H01R 3/00*** | (2006.01) |
| ***H01R 13/642*** | (2006.01) |
| ***H01R 12/79*** | (2011.01) |
| *H01R 13/627* | (2006.01) |

(52) U.S. Cl.

CPC ..... *H01R 13/642* (2013.01); *H01R 12/79* (2013.01); *H01R 13/6272* (2013.01)

(58) Field of Classification Search

CPC ..... H01R 12/79

USPC ..... 439/495, 660

See application file for complete search history.

(56) References Cited

U.S. PATENT DOCUMENTS

| | | | | |
|---|---|---|---|---|
| 5,562,487 | A * | 10/1996 | Ii et al. | 439/495 |
| 2002/0094717 | A1 | 7/2002 | Sakai et al. | |
| 2002/0119696 | A1 | 8/2002 | Okamura et al. | |

FOREIGN PATENT DOCUMENTS

| | | | |
|---|---|---|---|
| JP | H07-230860 | A | 8/1995 |
| JP | 2001-185265 | A | 7/2001 |
| JP | 2001-257019 | A | 9/2001 |
| JP | 2002-141127 | A | 5/2002 |
| JP | 2002-252048 | A | 9/2002 |
| JP | 2002-280104 | A | 9/2002 |
| JP | 2003-157928 | A | 5/2003 |
| JP | 2005-078842 | A | 3/2005 |
| JP | 2008-300129 | A | 12/2008 |
| KR | 10-2010-0089756 | A | 8/2010 |

OTHER PUBLICATIONS

The Korean office action issued on Jul. 29, 2014 in the counterpart Korean patent application. (Partial English translation also submitted.).

The Japanese office action issued on Dec. 2, 2014 in the counterpart Japanese patent application.

(Continued)

*Primary Examiner* — Phuong Dinh

(74) *Attorney, Agent, or Firm* — Marvin A. Motsenbocker; Mots Law, PLLC

(57) ABSTRACT

A connector device includes a connector and a slider inserted into the connector. A terminal pressing portion of the slider is configured to press a terminal contact portion of a terminal of the connector before a tip end of a flat circuit body of the slider reaches a position of a tip end of the terminal in an insertion process of the terminal pressing portion into a slider fitting chamber of the connector.

5 Claims, 12 Drawing Sheets

(56) References Cited

OTHER PUBLICATIONS

The Korean office action letter issued on Feb. 5, 2015 in the counterpart Korean patent application.

Chinese office action letter issued on Mar. 23, 2015 in the counterpart Chinese patent application.

Japanese office action letter issued on Apr. 7, 2015 in the counterpart Japanese patent application.

* cited by examiner

CONNECTOR DEVICE

CROSS REFERENCE TO RELATED APPLICATION

This application is a Continuation of PCT Application No. PCT/JP2012/057009, filed on Mar. 19, 2012, and claims the priority of Japanese Patent Application No. 2011-062653, filed on Mar. 22, 2011, the content of both of which is incorporated herein by reference.

BACKGROUND

1. Technical Field

The present invention relates to a connector device which is used for the electrical connection with a flat circuit body such as a flexible flat cable.

2. Related Art

As a connector device, various connector devices for connection between a circuit on a circuit board and a flat circuit body such as a flexible flat cable (FFC) or a flexible printed circuit (FPC) with electric wires have been suggested (refer to Japanese Unexamined Patent Application Publication No. 2005-78842 and Japanese Unexamined Patent Application Publication No. 2002-141127). An example related to this type of connector device is illustrated in FIGS. 1 to 4.

As illustrated in FIG. 1, a connector device 100 includes a connector 101 fixed onto a circuit board (not illustrated) and a slider 120 fitted to the connector 101 through sliding insertion.

As illustrated in FIG. 2, the connector 101 includes a connector housing 102 and a plurality of terminals 110. The connector housing 102 includes a slider fitting chamber 103 into which an insertion guide portion 122 of the slider 120 is inserted, and a plurality of terminal accommodation chambers 104 which are arranged in parallel at intervals in a direction orthogonal to an insertion direction of the insertion guide portion 122. The slider fitting chamber 103 is open to the outside by an insertion opening 103*a*. Each of the terminal accommodation chambers 104 is formed to surround the upper, lower, and inner peripheries of the slider fitting chamber 103. Each of the terminal accommodation chambers 104 is open to the upper surface, the lower surface, and the inner surface of the slider fitting chamber 103. A press-fitting wall portion 105 is provided in each of the terminal accommodation chambers 104 of the connector housing 102.

The terminal 110 includes a first connection portion 111 connected to a contact point (not illustrated) of a circuit board side and a second connection portion 112 connected to a contact point (not illustrated) of a flat circuit body 130. The first connection portion 111 is disposed on the outer side of the connector housing 102. The first connection portion 111 is connected to the contact point (not illustrated) of the circuit board side by soldering. The second connection portion 112 includes an interposed press-fitting portion 113 and a terminal contact portion 114 which are disposed at an interval therebetween. The terminal 110 is fixed to the connector housing 102 by the interposed press-fitting portion 113 being press-fitted between the press-fitting wall portion 105 and an upper surface wall portion 102*a*. The interposed press-fitting portion 113 and the terminal contact portion 114 are disposed at the upper and lower positions of the terminal accommodation chamber 104 and are disposed to oppose each other with the slider fitting chamber 103 interposed therebetween.

The terminal contact portion 114 includes a contact protrusion 114*a* which protrudes toward the slider fitting chamber 103. A tapered surface 114*c* is formed from the contact protrusion 114*a* to a tip end 114*b*. The terminal contact portion 114 is disposed in the terminal accommodation chamber 104 in a state where the contact protrusion 114*a* protrudes toward the slider fitting chamber 103.

As illustrated in FIG. 3, the slider 120 includes a slider body 121 and a pressing cover 125 which causes the tip end of the flat circuit body 130 to be interposed between the bottom surface of the slider body 121 and the pressing cover 125.

The slider body 121 includes the insertion guide portion 122 inserted into the slider fitting chamber 103. The tip end of the insertion guide portion 122 is provided with a terminal pressing portion 123 which protrudes downward. The terminal pressing portion 123 has a tapered surface 123*a* formed on the lower surface thereof. The flat circuit body 130 is disposed along the bottom surface of the slider body 121 so that a tip end 130*a* (see FIGS. 4A and 4B) of the flat circuit body 130 is positioned on the rear end of the tapered surface 123*a*.

The pressing cover 125 fixes the flat circuit body 130 at a position in front of a contact point position of the flat circuit body 130.

In the above-described configuration, the insertion guide portion 122 of the slider 120 is inserted into the slider fitting chamber 103 from the insertion opening 103*a* of the connector 101. As illustrated in FIG. 4A, the tapered surface 123*a* of the terminal pressing portion 123 then abuts on the contact protrusion 114*a* of the terminal 110 which protrudes toward the slider fitting chamber 103, and the terminal contact portion 114 is elastically deformed in the depth direction of the terminal accommodation chamber 104 by the pressing force, which allows the insertion of the insertion guide portion 122. The terminal contact portion 114 is gradually displaced in the depth direction of the terminal accommodation chamber 104 by following the tapered surface 123*a* of the terminal pressing portion 123. In addition, even when the tip end 130*a* of the flat circuit body 130 is slightly lowered from the bottom surface of the insertion guide portion 122, the tapered surface 123*a* of the terminal pressing portion 123 takes the tip end 130*a* of the flat circuit body 130 onto the lower surface of the flat circuit body 130 and slides thereon. When the insertion guide portion 122 is inserted to an insertion completion position, the contact protrusion 114*a* of the terminal contact portion 114 comes in pressure contact with the contact point (not illustrated) of the flat circuit body 130 by the elastic restoring force.

SUMMARY

However, the connector 101 is mounted on the circuit board (not illustrated) by reflow soldering and at this time, is exposed to a high-temperature environment. Since the connector housing 102 is made of a synthetic resin, there is concern that the connector housing 102 may be deformed in shapes when being exposed to the high-temperature environment. In the shape deformation due to heat, as indicated by the virtual line of FIG. 2, typically, the upper surface wall portion 102*a* of the connector housing 102 is deformed to be bent upward, and the terminal 110 is displaced by following the deformation. That is, the rear end portion of the upper surface wall portion 102*a* presses down (in the arrow AR1 direction of FIG. 2) the rear end portion of the terminal 110, and the terminal 110 is rotated about the press-fitting wall portion 105 as the fulcrum such that the tip end of the terminal 110 is displaced in the upward direction (the arrow AR2 direction of FIG. 2). When the terminal 110 is displaced from its normal position as such, as illustrated in FIG. 4B, the tip end 114*b* of the terminal contact portion 114 comes out of the terminal accommodation chamber 104 and is positioned in the slider fitting chamber 103. In this case, before the terminal pressing portion 123 of the insertion guide portion 122 comes into contact with the terminal contact portion 114, the tip end 114*b* of the terminal contact portion 114 abuts on the tip end 130*a* of the flat circuit body 130, and the flat circuit body 130, the terminal 110, and the like are deformed and damaged, resulting in a possibility of contact failure.

Particularly, along with a reduction in the size of the connector device 100, it becomes difficult to achieve dimension margins in consideration of a safety factor in the dimension relationship between the terminal 110 and the connector housing 102, and thus prevention of contact failure as described above is desired.

An object of the present invention is to provide a connector device capable of allowing a flat circuit body and a terminal to reliably come into contact with each other and thus providing high fitting reliability even in a case where a tip end of a terminal contact portion protrudes toward a slider fitting chamber.

A connector device in accordance with some embodiments includes a connector and a slider. The connector includes: a connector housing having a slider fitting chamber and a terminal accommodation chamber opening to the slider fitting chamber; and a terminal having a terminal contact portion accommodated in the terminal accommodation chamber to be elastically deformable and protruding toward the slider fitting chamber. The slider includes: an insertion guide portion inserted into the slider fitting chamber in an inserting direction; a terminal pressing portion provided toward a tip end of the insertion guide portion and configured to press the terminal contact portion in a depth direction of the terminal accommodation chamber to elastically deform the terminal contact portion in an insertion process of the insertion guide portion; and a flat circuit body disposed rearward of the terminal pressing portion in the insertion direction. The terminal pressing portion is configured to press the terminal contact portion before a tip end of the flat circuit body reaches a position of a tip end of the terminal in an insertion process of the terminal pressing portion into the slider fitting chamber.

The terminal pressing portion may includes: a tapered surface inclined in a direction to gradually increase an elastic displacement amount of the terminal contact portion from a tip end toward a rear of the terminal pressing portion in the insertion direction; and a straight surface disposed toward a rear end of the tapered surface in the insertion direction and extending along an insertion direction of the insertion guide portion.

In the above-described configuration, when the insertion guide portion of the slider is inserted into the slider fitting chamber, the terminal pressing portion presses the contact protrusion before the tip end of the flat circuit body reaches the tip end position of the terminal, and the terminal contact portion is elastically deformed in the depth direction of the terminal accommodation chamber by the pressing force. Therefore, in the case where the tip end of the terminal contact portion protrudes toward the slider fitting chamber, a situation does not occur in which the tip end of the terminal contact portion is displaced toward the terminal accommodation chamber and the tip end of the terminal contact portion abuts on the tip end of the flat circuit body. Accordingly, even in the case where the tip end of the terminal contact portion protrudes toward the slider fitting chamber, the flat circuit body and the terminal can reliably come into contact with each other, and thus a connector device having high fitting reliability can be provided.

DETAILED DESCRIPTION

Hereinafter, an embodiment of the present invention will be described with reference to the drawings.

Figure 1:
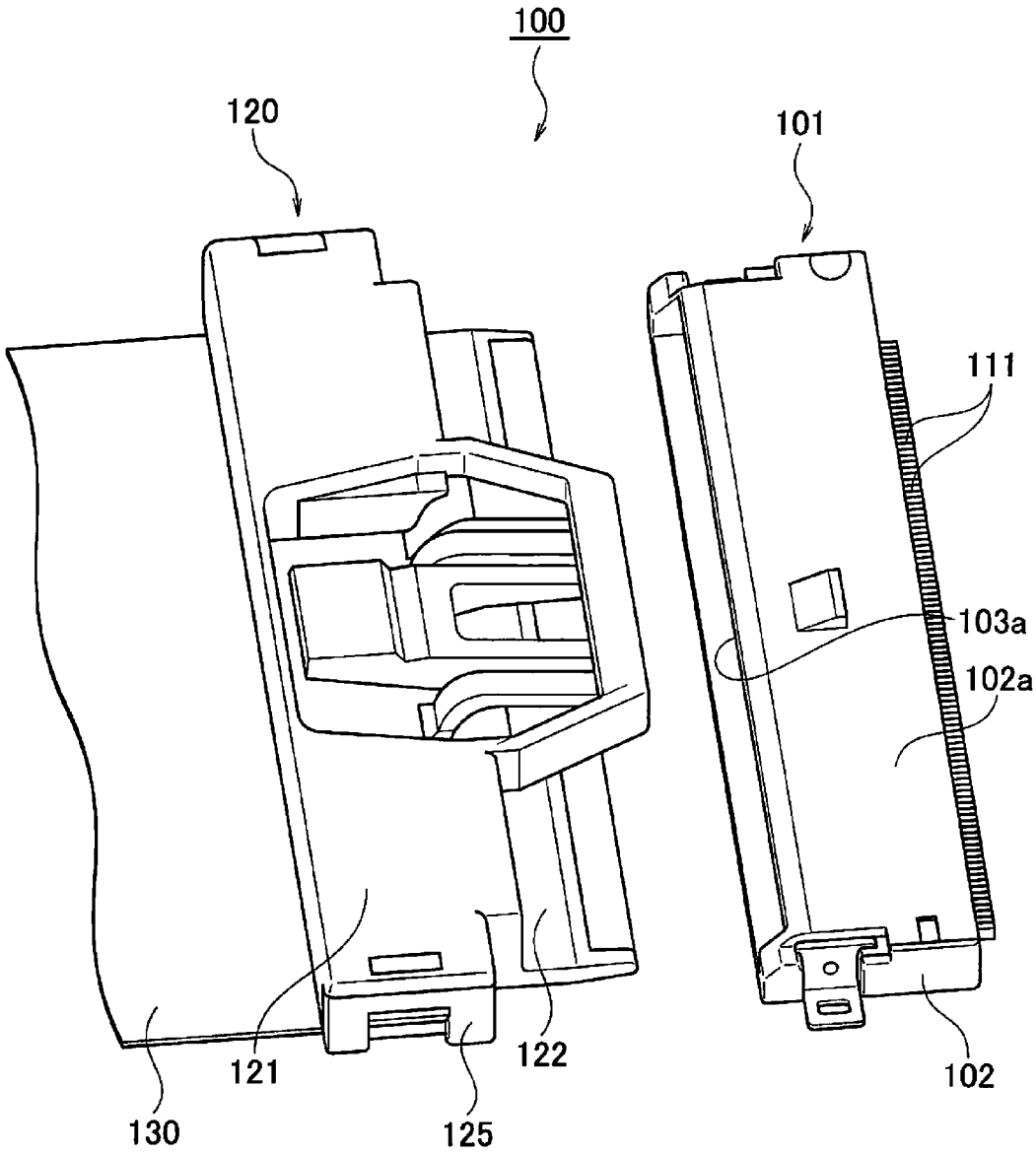
FIG. 1 RELATED ART
FIG. 1 illustrates a related example and is a perspective view of a connector device.
Figure 2:
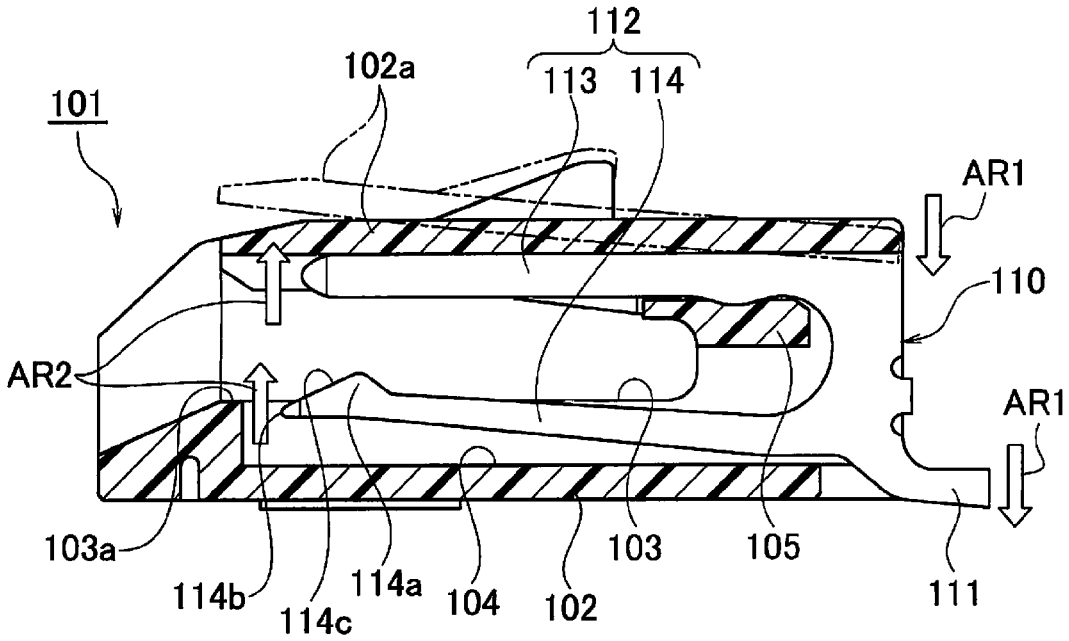
FIG. 2 RELATED ART
FIG. 2 illustrates the related example and is a cross-sectional view of a connector.
Figure 3:
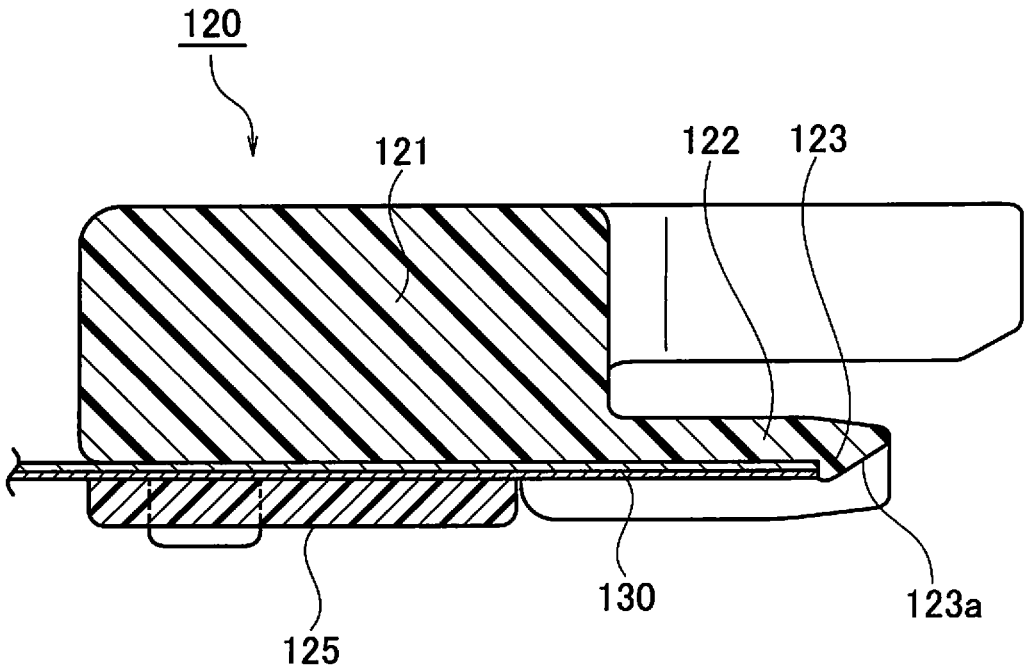
FIG. 3 RELATED ART
FIG. 3 illustrates the related example and is a cross-sectional view of a slider.
Figure 4A:
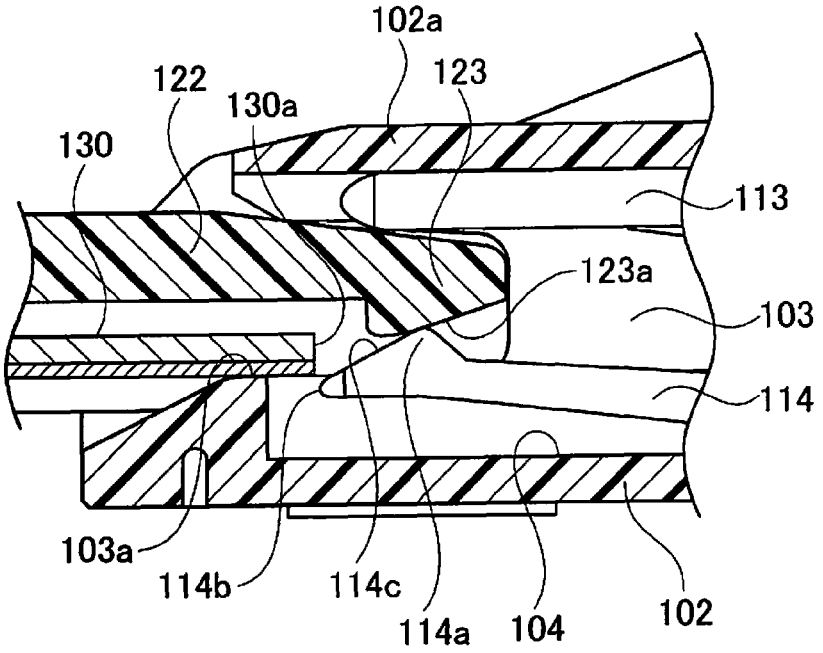
FIG. 4A RELATED ART
FIG. 4A illustrates the related example, and is a cross-sectional view of main parts, illustrating a process of inserting an insertion guide portion of the slider into a slider fitting chamber of the connector in a case where a tip end of a terminal contact portion is positioned inside a terminal accommodation chamber.
Figure 4B:
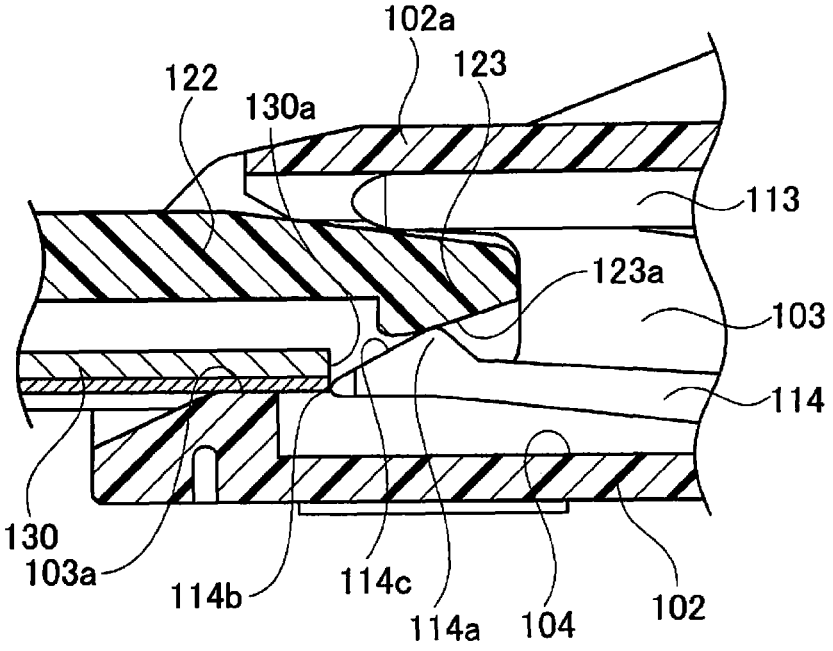
FIG. 4B RELATED ART
FIG. 4B illustrates the related example, and is a cross-sectional view of main parts, illustrating a process of inserting the insertion guide portion of the slider into the slider fitting chamber of the connector in the case where the tip end of the terminal contact portion protrudes toward the slider fitting chamber.
Figure 5:
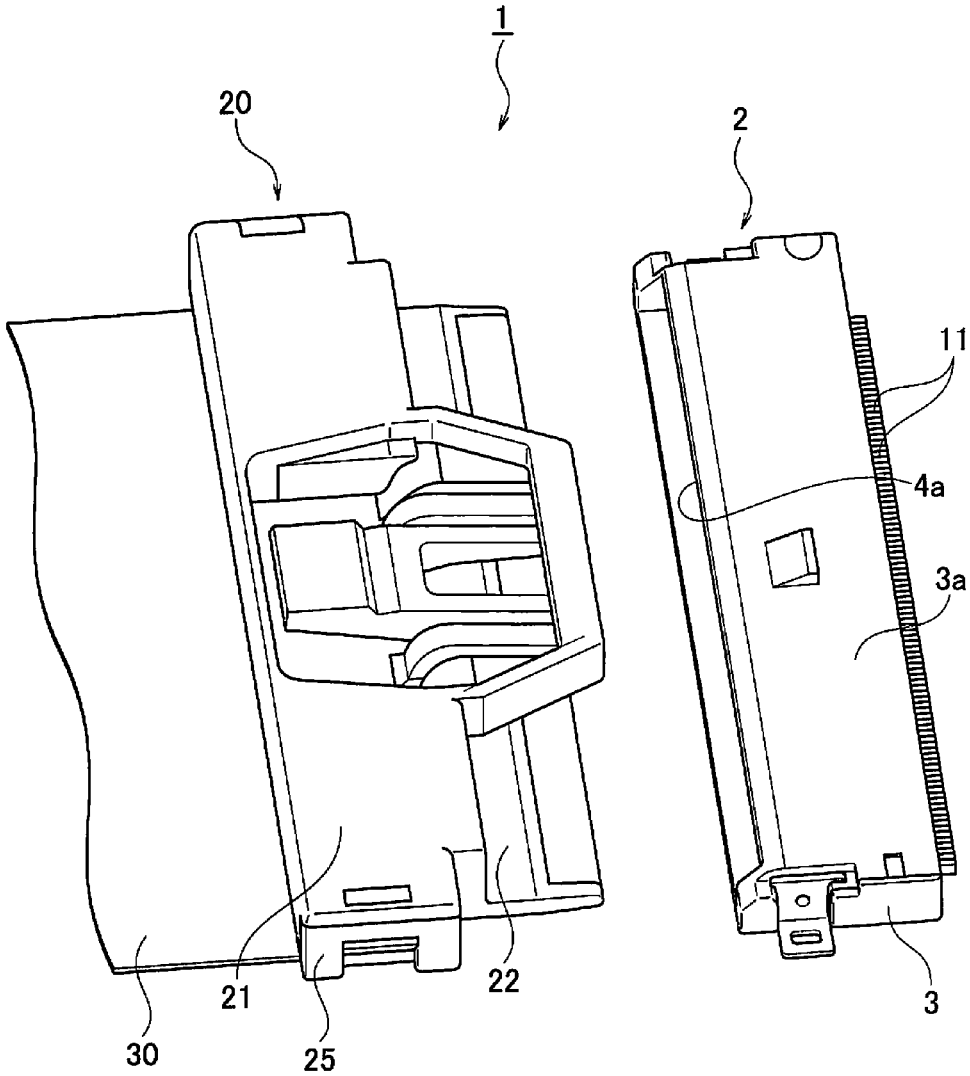
FIG. 5 illustrates an embodiment of the present invention, and is a perspective view of a connector device.

FIGS. 5 to 12B illustrate the embodiment of the present invention. As illustrated in FIG. 5, a connector device 1 includes a connector 2 fixed onto a circuit board (not illustrated) and a slider 20 fitted to the connector 2 through sliding insertion.

Figure 6A:
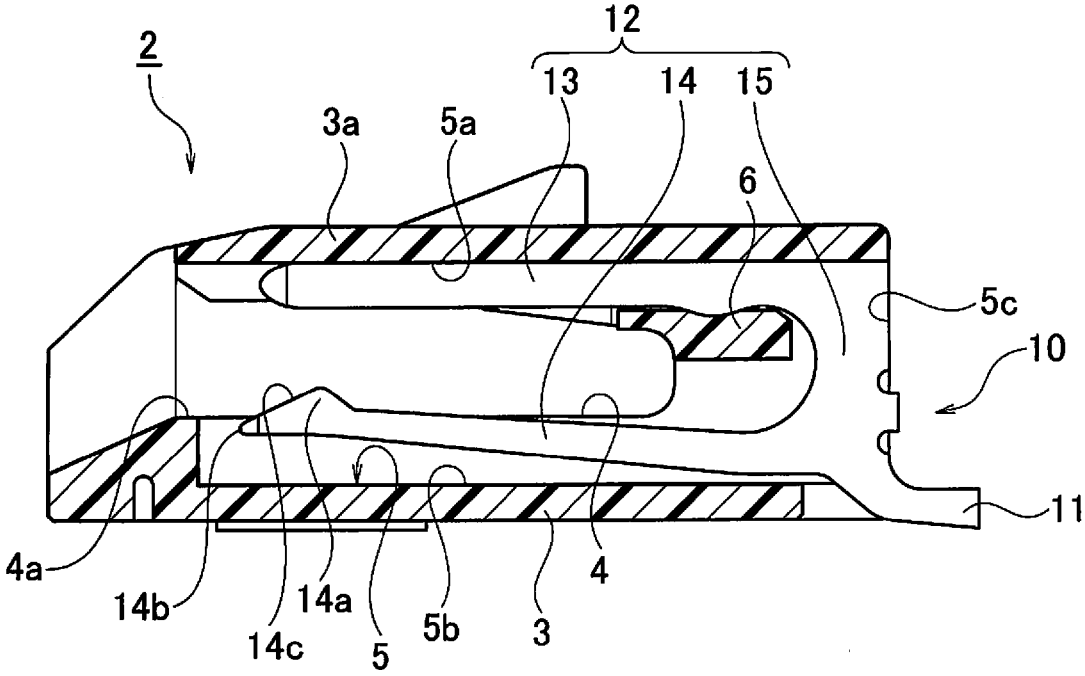
FIG. 6A illustrates the embodiment of the present invention, and is a cross-sectional view of a connector.

As illustrated in FIG. 6A, the connector 2 includes a connector housing 3 and a plurality of terminals 10. The connector housing 3 is formed of a synthetic resin material having insulating properties. The connector housing 3 includes a slider fitting chamber 4 into which an insertion guide portion 22 of the slider 20 is inserted, and a plurality of terminal accommodation chambers 5 which are arranged in parallel at intervals in a direction orthogonal to an insertion direction of the insertion guide portion 22. The slider fitting chamber 4 has an insertion opening 4*a* formed on the forward side thereof. Each of the terminal accommodation chambers 5 is formed to surround the upper, lower, and inner peripheries of the slider fitting chamber 4. The terminal accommodation chamber 5 is constituted by an upper accommodation chamber 5*a* positioned on the upper side of the slider fitting chamber 4, a lower accommodation chamber 5*b* positioned on the lower side of the slider fitting chamber 4, and a base portion accommodation chamber 5*c* which allows the upper accommodation chamber 5*a* and the lower accommodation chamber 5*b* to communicate with each other. The upper accommodation chamber 5*a* and the lower accommodation chamber 5*b* are respectively open to the upper and lower surfaces of the slider fitting chamber 4.

A press-fitting wall portion 6 which penetrates through the base portion accommodation chamber 5*c* of the terminal accommodation chamber 5 is provided in the connector housing 3.

Figure 6B:
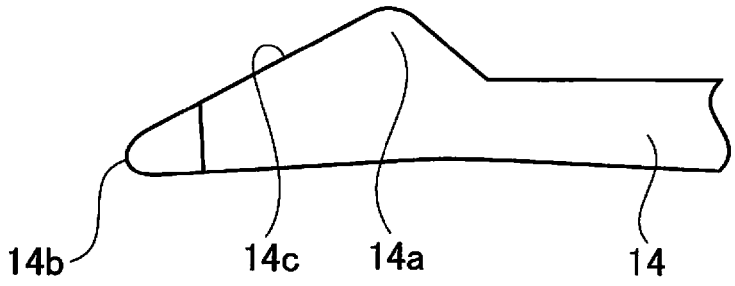
FIG. 6B illustrates the embodiment of the present invention, and is an enlarged side view of main parts of a terminal.
Figure 7:
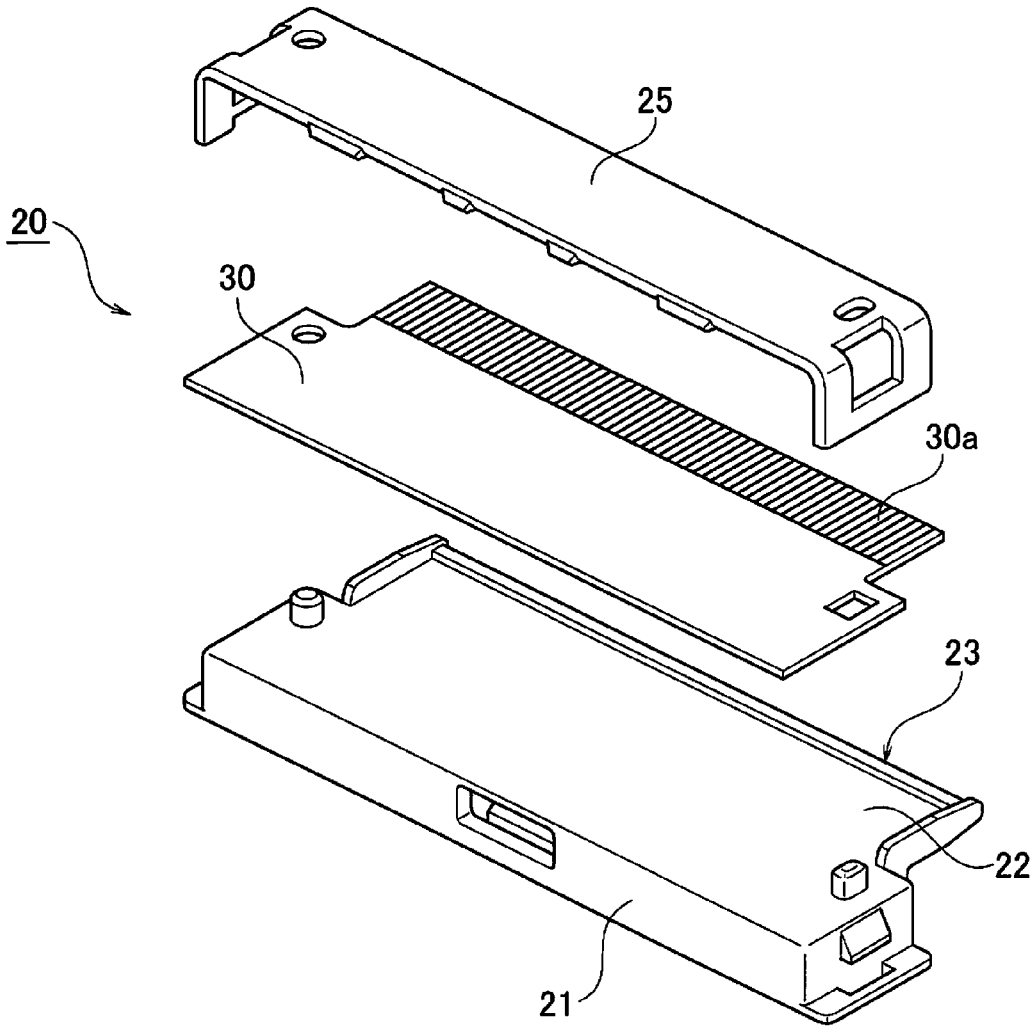
FIG. 7 illustrates the embodiment of the present invention, and is an exploded perspective view viewed from the bottom surface of a slider.
Figure 8A:
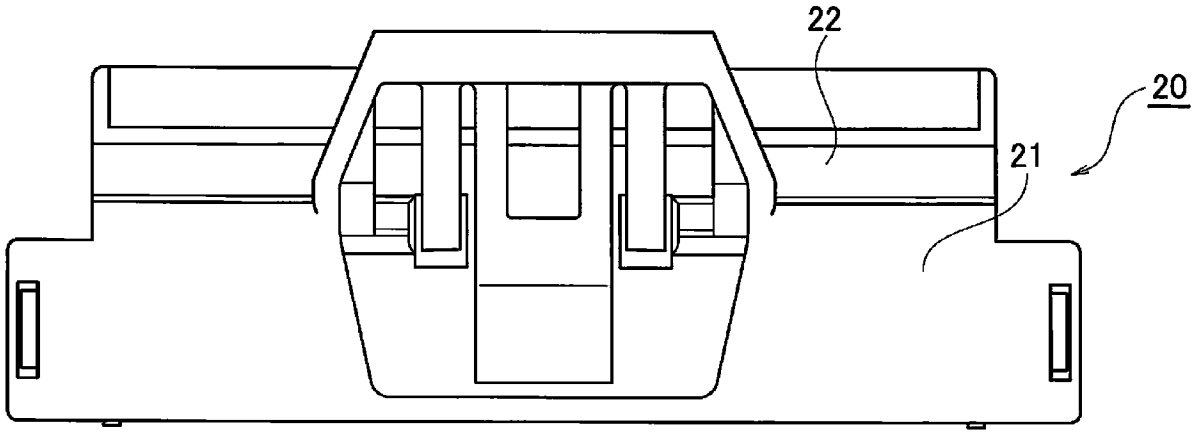
FIG. 8A illustrates the embodiment of the present invention, and is a plan view of the slider.
Figure 8B:
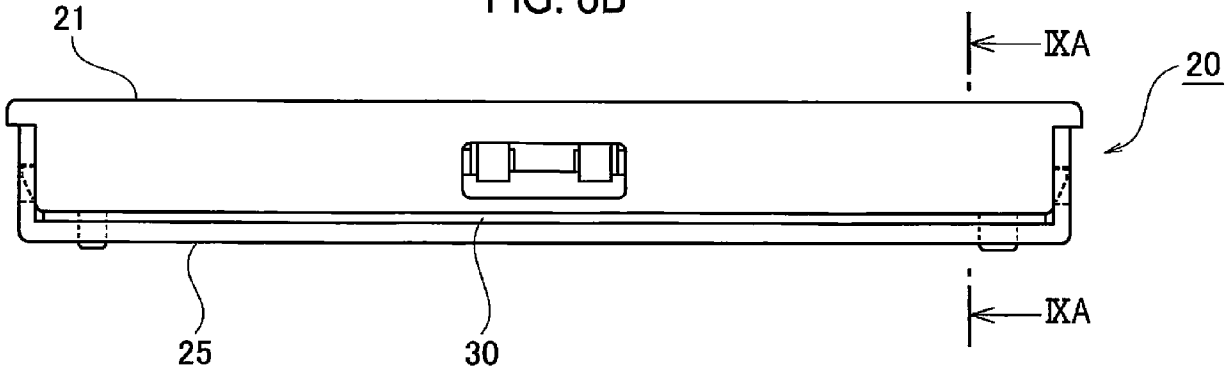
FIG. 8B illustrates the embodiment of the present invention, and is a front view of the slider.

As illustrated in FIGS. 6A and 6B, the terminal 10 is formed of a conductive metal plate. The terminal 10 includes a first connection portion 11 connected to a contact point (not illustrated) of a circuit board and a second connection portion 12 connected to a contact point 31 of the flat circuit body 30. The first connection portion 11 is disposed on the outer side of the connector housing 3. The first connection portion 11 is connected to the contact point (not illustrated) of the circuit board by soldering. The second connection portion 12 includes an interposed press-fitting portion 13 and a terminal contact portion 14 which are disposed at an interval therebetween, and a connection base portion 15 which connects the interposed press-fitting portion 13 and the terminal contact portion 14.

The interposed press-fitting portion 13 and the terminal contact portion 14 are respectively disposed in the upper accommodation chamber 5*a* and the lower accommodation chamber 5*b*. Accordingly, the interposed press-fitting portion 13 and the terminal contact portion 14 are disposed to oppose each other with the slider fitting chamber 4 interposed therebetween. The interposed press-fitting portion 13 is press-fitted between the press-fitting wall portion 6 and the upper surface wall portion 3*a*. The terminal 10 is fixed to the connector housing 3 by the press-fitting force. The terminal contact portion 14 includes a contact protrusion 14*a* which protrudes toward the slider fitting chamber 4. A tapered surface 14*c* is formed from the contact protrusion 14*a* to a tip end 14*b*. Typically, the terminal contact portion 14 is disposed in the lower accommodation chamber 5*b* of the terminal accommodation chamber 5 in a state where the contact protrusion 14*a* protrudes toward the slider fitting chamber 4. The connection base portion 15 is disposed in the base portion accommodation chamber 5*c* of the terminal accommodation chamber 5.

As illustrated in FIGS. 7, 8A, 8B, and 9A, the slider 20 includes a slider body 21 and a pressing cover 25 which causes the tip end side of the flat circuit body 30 to be interposed between the bottom surface of the slider body 21 and the pressing cover 25.

The slider body 21 includes the insertion guide portion 22 inserted into the slider fitting chamber 4. Toward the tip end of the insertion guide portion 22, a terminal pressing portion 23 which protrudes downward is provided. The terminal pressing portion 23 is provided to press the terminal contact portion 14 before a tip end 30*a* of the flat circuit body 30 reaches the position of the tip end 14*b* of the terminal 10 in a process of an insertion into the slider fitting chamber 4. Specifically, the terminal pressing portion 23 includes a tapered surface 23*a* which is inclined in such a direction that an elastic displacement amount of terminal contact portion 14 is gradually increased from the tip end toward the rear of the terminal pressing portion 23 in the insertion direction, and a straight surface 23*b* which is disposed toward the rear end of the tapered surface 23*a* in the insertion direction and extends along the insertion direction of the insertion guide portion 22.

Figure 9A:
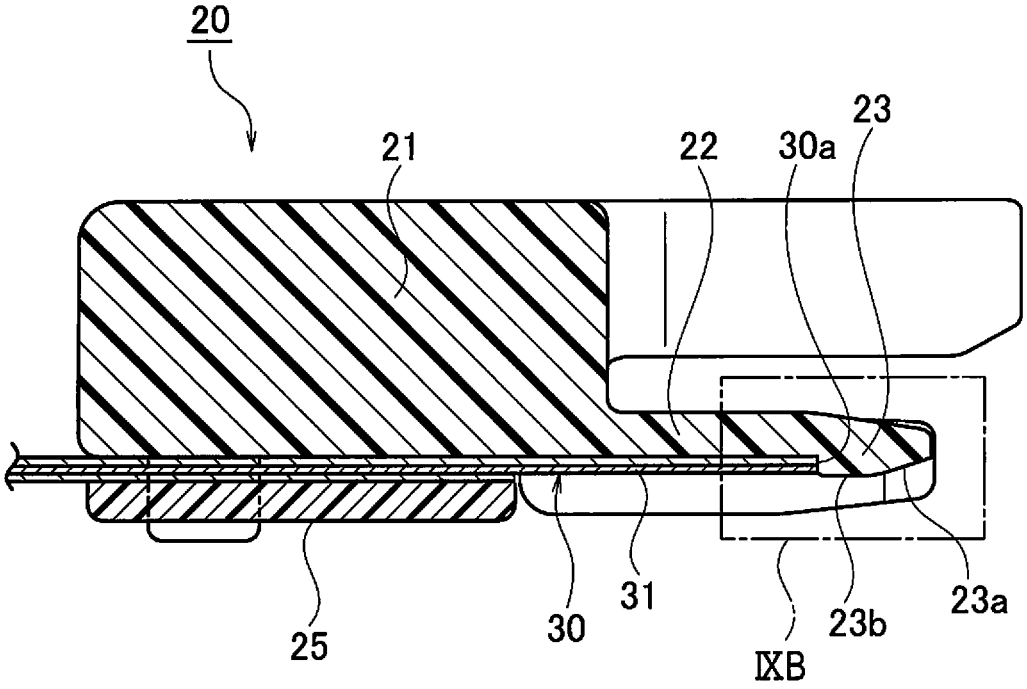
FIG. 9A illustrates the embodiment of the present invention, and is a cross-sectional view taken along the line IXA-IXA of FIG. 8B
Figure 9B:
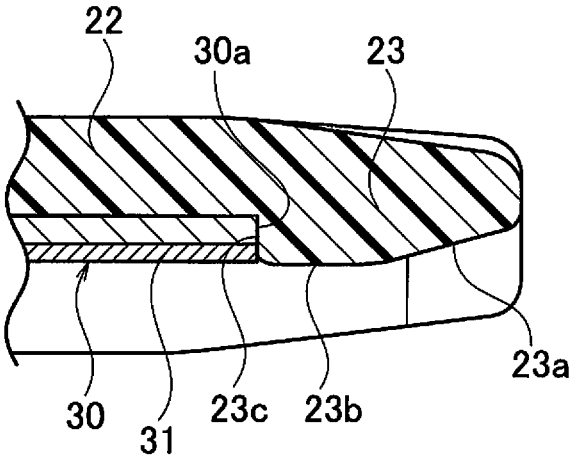
FIG. 9B is an enlarged view of the part IXB of FIG. 9A.

The flat circuit body 30 has a highly-flexible and flat circuit body. The flat circuit body 30 is a flexible flat cable (FFC), a flexible printed circuit (FPC), or the like. The tip end of the flat circuit body 30 is disposed at the bottom surface of the slider body 21 and toward the rear end of the terminal pressing portion 23. Specifically, as illustrated in FIG. 9B, a stepped surface 23*c* is formed at the rear end of the straight surface 23*b* of the terminal pressing portion 23 between the bottom surface of the slider body 21 and the rear end thereof. The tip end 30*a* of the flat circuit body 30 is disposed to follow the stepped surface 23*c*.

A plurality of the contact points 31 are provided in parallel on the tip end of the flat circuit body 30. The plurality of the contact points 31 are configured by exposing a conductive pattern.

The pressing cover 25 fixes the flat circuit body 30 at a position in front of the contact point position of the flat circuit body 30.

Figure 10:
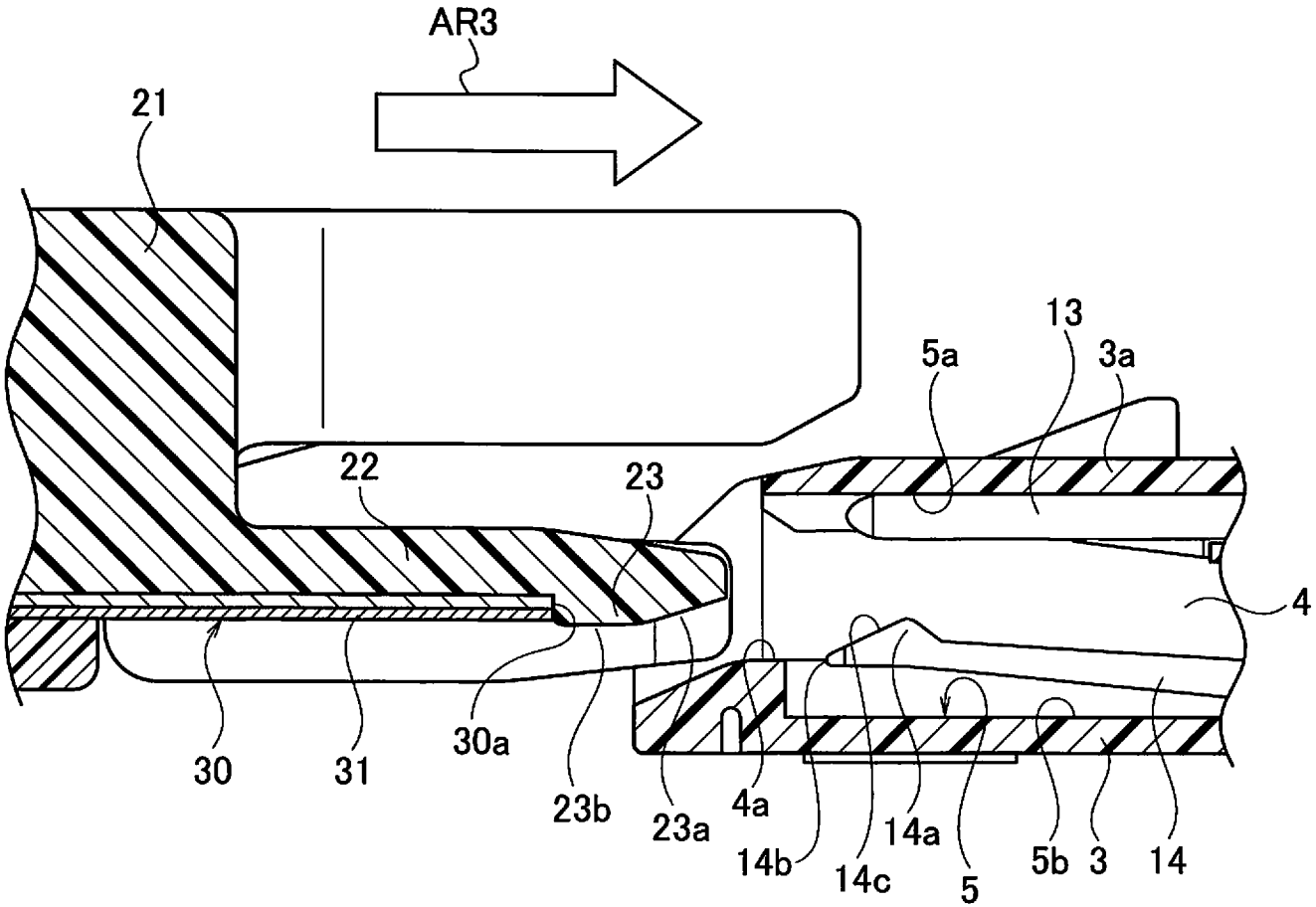
FIG. 10 illustrates the embodiment of the present invention, and is a cross-sectional view of main parts, illustrating a process of inserting an insertion guide portion of the slider into a slider fitting chamber of the connector.
Figure 11A:
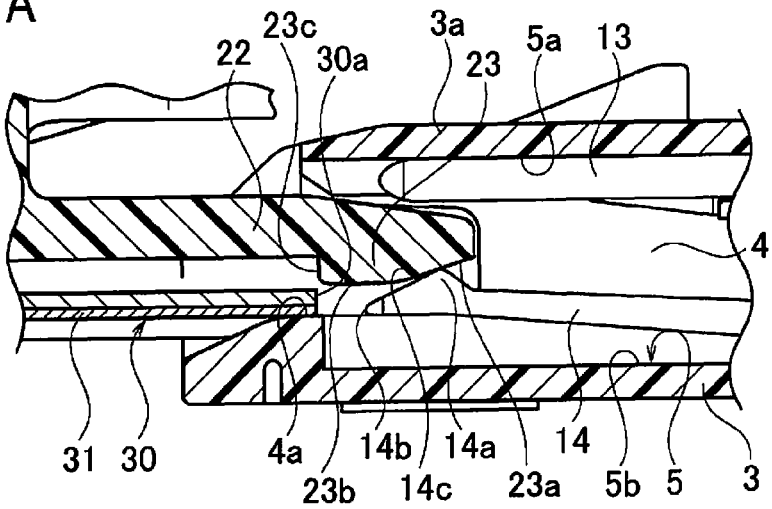
FIGS. 11A to 11C illustrate the embodiment of the present invention, and are cross-sectional views of main parts, illustrating a process of inserting the insertion guide portion of the slider into the slider fitting chamber of the connector.
Figure 11B:
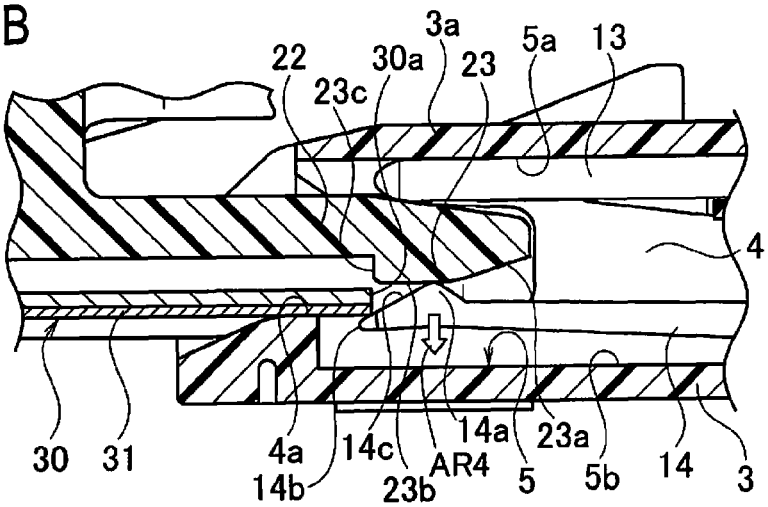
Figure 11C:
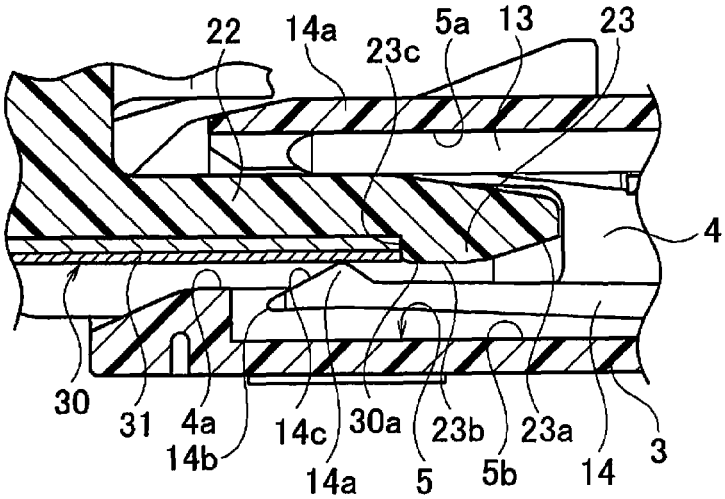

Next, an operation of fitting of the slider 20 to the connector 2 will be described. As illustrated in FIG. 10, the insertion guide portion 22 of the slider 20 is inserted into the slider fitting chamber 4 from the insertion opening 4*a* of the connector 2 in the arrow AR3 direction. As illustrated in FIG. 11A, the insertion guide portion 22 then enters between the interposed press-fitting portion 13 and the terminal contact portion 14 of the terminal 10. In addition, the tapered surface 23*a* of the terminal pressing portion 23 comes into contact with the contact protrusion 14*a* of the terminal 10 which protrudes toward the slider fitting chamber 4, and the terminal contact portion 14 is elastically deformed by the pressing force in the depth direction of the terminal accommodation chamber 5 to be displaced. Accordingly, the insertion of the insertion guide portion 22 is allowed. The terminal contact portion 14 is gradually displaced in the depth direction (the arrow AR4 direction of FIG. 11B) of the terminal accommodation chamber 5 by following the tapered surface 23*a* of the terminal pressing portion 23. Therefore, as illustrated in FIG. 11B, even when the tip end 30*a* of the flat circuit body 30 is slightly lowered from the bottom surface of the insertion guide portion 22, the tip end 14*b* of the terminal contact portion 14 enters the lower side of the flat circuit body 30 without abutting on the tip end 30*a* of the flat circuit body 30. Further, when the terminal contact portion 14 reaches a position which comes into contact with the straight surface 23*b* from the tapered surface 23*a* of the terminal pressing portion 23, the terminal contact portion 14 slides on the straight surface 23*b* while holding its maximum elastic displacement amount. In addition, as illustrated in FIG. 11C, when the insertion guide portion 22 is inserted to the insertion completion position, the contact protrusion 14*a* of the terminal contact portion 14 is at a position which opposes the contact point (not illustrated) of the flat circuit body 30, and the contact protrusion 14*a* of the terminal contact portion 14 comes in pressure contact with the contact point 31 of the flat circuit body 30 by the elastic restoring force.

In the above-described fitting operation, there may be a situation in which the tip end 14*b* of the terminal contact portion 14 of the terminal 10 protrudes toward the slider fitting chamber 4 due to the thermal deformation or the like of the connector housing 3. Even in this case, when the insertion guide portion 22 of the slider 20 is inserted into the slider fitting chamber 4 from the insertion opening 4*a*, as illustrated in FIG. 11A, the terminal pressing portion 23 presses the contact protrusion 14*a* before the tip end 30*a* of the flat circuit body 30 reaches the position of the tip end 14*b* of the terminal 10. Therefore, as illustrated in FIG. 11B, even when the tip end 30*a* of the flat circuit body 30 is slightly lowered from the bottom surface of the insertion guide portion 22, the tip end 14*b* of the terminal contact portion 14 enters the lower side of the flat circuit body 30 without occurrence of a situation in which the tip end 14*b* of the terminal contact portion 14 abuts on the tip end 30*a* of the flat circuit body 30. Accordingly, even in the case where the tip end 14*b* of the terminal contact portion 14 protrudes toward the slider fitting chamber 4, the flat circuit body 30 and the terminal 10 can be allowed to reliably come into contact with each other, and thus fitting reliability is high.

Figure 12A:
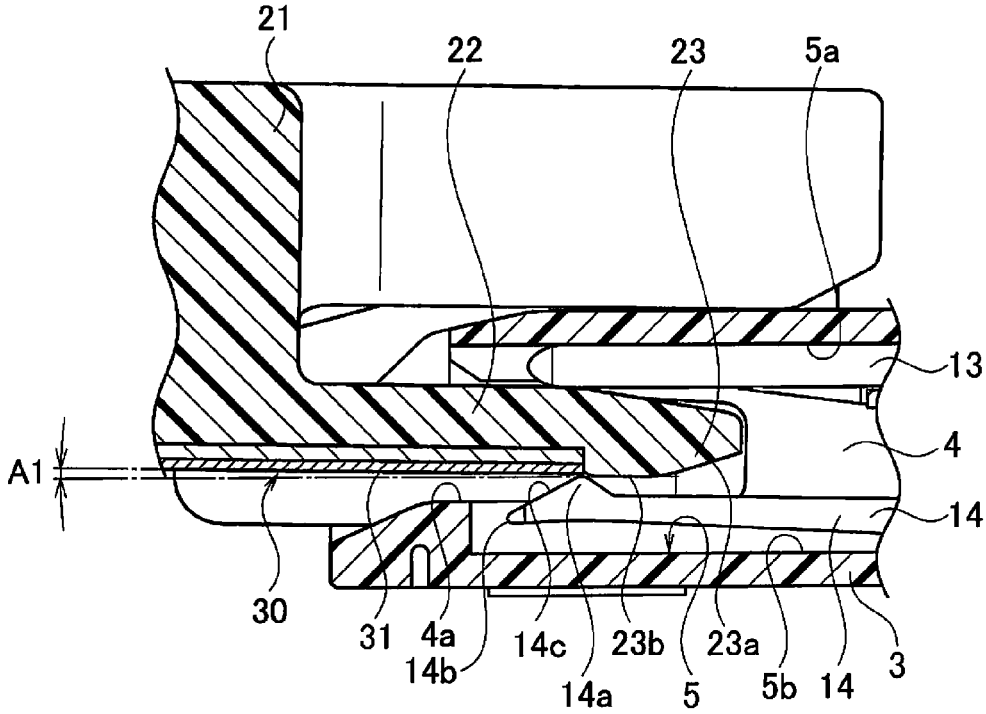
FIG. 12A is a cross-sectional view illustrating an inclination insertion angle of the insertion guide portion of the slider in the embodiment.
Figure 12B:
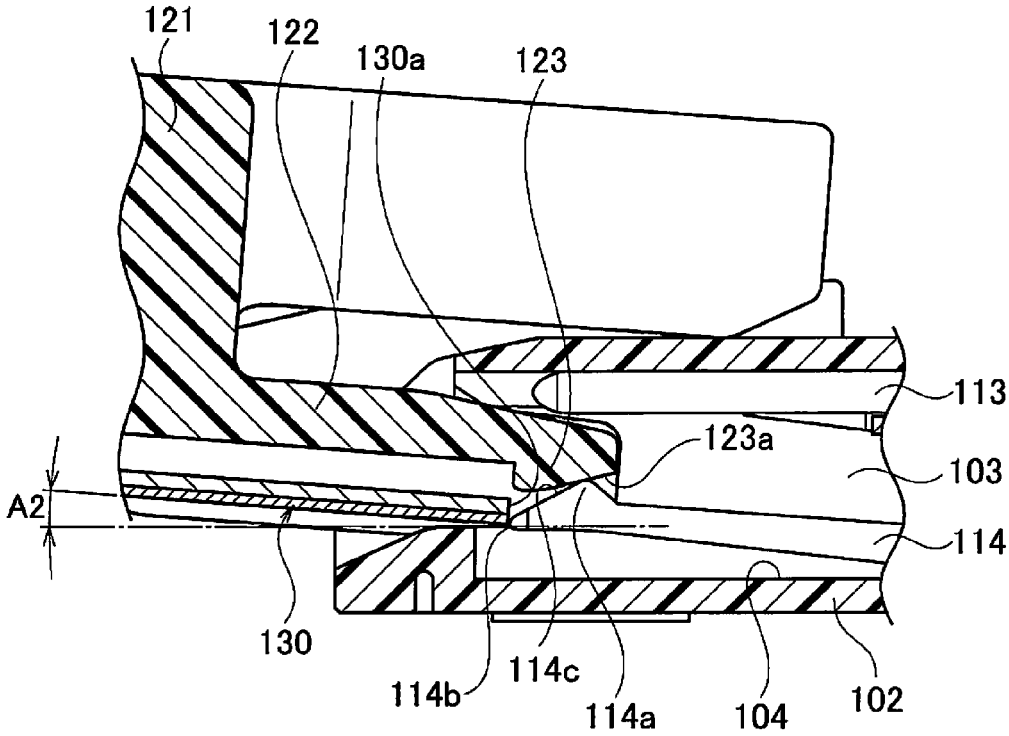
FIG. 12B RELATED ART
FIG. 12B is a cross-sectional view illustrating an inclination insertion angle of the insertion guide portion of the slider in the related example.

In the fitting operation, the shallowest position of the insertion guide portion 22 where the tip end of the flat circuit body 30 and the terminal contact portion 14 come into contact with each other, as illustrated in FIG. 12A, is the position where the contact protrusion 14*a* of the terminal contact portion 14 comes into contact with the tip end 30*a* of the flat circuit body 30. Contrary to this, in the related example, as illustrated in FIG. 12B, the shallowest position is the position where the tip end 114*b* of the terminal contact portion 114 comes into contact with the tip end 130*a* of the flat circuit body 130. Therefore, the connector device 1 according to the embodiment of the present invention is at a position which is inserted by the dimension between the contact protrusion 14*a* and the tip end 14*b* of the terminal contact portion 14, and the flat circuit body 30 and the terminal contact portion 14 start coming into contact with each other at a smaller insertion inclination angle (angle A1<angle A2) in the present invention compared to the related art. Accordingly, even when methods of the fitting operation by operators vary, the fitting operation can be performed in a state where the insertion inclination angle A1 is small at a time point where the flat circuit body 30 and the terminal contact portion 14 start coming into contact with each other, that is, in a state with no variation in the insertion inclination angle, and thus stable fitting reliability can be secured.

The terminal pressing portion 23 includes the tapered surface 23*a* which is inclined in such a direction that the elastic displacement amount of terminal contact portion 14 is gradually increased from the tip end toward the rear of the terminal pressing portion 23 in the insertion direction, and the straight surface 23*b* which is disposed toward the rear end of the tapered surface 23*a* in the inserting direction and extends along the insertion direction of the insertion guide portion 22. Therefore, in the first half of the insertion process, the terminal contact portion 14 can be displaced to the insertion position that is the maximum displacement position at which the sliding of the contact protrusion 14*a* of the terminal contact portion 14 on the tapered surface 23*a* is ended, and thus the dimension relationship between the terminal 10 and the connector housing 3 can be set by sufficiently considering a safety factor. Accordingly, the terminal contact portion 14 can reliably enter the lower position of the flat circuit body 30, and thus fitting reliability is further enhanced. That is, even when a reduction in the size of the connector device 100 has proceeded, dimension margins in consideration of a safety factor in the dimension relationship between the terminal 10 and the connector housing 3 can be achieved.

The terminal 10 includes the interposed press-fitting portion 13 and the terminal contact portion 14 which are disposed at an interval therebetween, and the insertion guide portion 22 of the slider 20 is interposed between the interposed press-fitting portion 13 and the terminal contact portion 14 to cause the terminal contact portion 14 to come in pressure contact with the flat circuit body 30. However, the terminal 10 is not limited thereto. The terminal 10 may also come in pressure contact with the flat circuit body 30 by an elastic restoring force of the terminal contact portion 14.

Embodiments of the present invention are described in the above. However, the present invention is not limited to the above embodiments and various modifications can be performed.

What is claimed is:

1. A connector device comprising:

a connector comprising a connector housing having a slider fitting chamber and a terminal accommodation chamber opening to the slider fitting chamber, and a terminal having a terminal contact portion accommodated in the terminal accommodation chamber to be elastically deformable and protruding toward the slider fitting chamber; and a slider comprising an insertion guide portion inserted into the slider fitting chamber in an inserting direction to an insertion completion position, a terminal pressing portion provided integrally with the insertion guide portion toward a tip end of the insertion guide portion and configured to press the terminal contact portion in a depth direction of the terminal accommodation chamber to elastically deform the terminal contact portion in an insertion process of the insertion guide portion, and a flat circuit body disposed rearward of the terminal pressing portion in the insertion direction and unmovably fixed to the insertion guide portion in a direction along the insertion direction, the flat circuit body being inserted into the slider fitting chamber together with the insertion guide portion, the flat circuit body with the insertion guide portion positioned at the insertion completion position being positioned to oppose the terminal contact portion, wherein the terminal pressing portion is configured to press the terminal contact portion before a tip end of the flat circuit body reaches a position of a tip end of the terminal in an insertion process of the insertion guide portion into the slider fitting chamber.

2. The connector device according to claim 1, wherein the terminal pressing portion comprises a tapered surface inclined in a direction to gradually increase an elastic displacement amount of the terminal contact portion from a tip end toward a rear of the terminal pressing portion in the insertion direction, and a straight surface disposed toward a rear end of the tapered surface in the insertion direction and extending along an insertion direction of the insertion guide portion.

3. The connector device according to claim 1, wherein the terminal contact portion comprises a contact protrusion configured to come in contact with the terminal pressing portion, and the terminal pressing portion has a length greater than a length from a tip end of the terminal contact portion to the contact protrusion in the inserting direction of the insertion guide portion into the slider fitting chamber.

4. The connector device according to claim 2, wherein the straight surface of the terminal pressing portion and surface of a contact point of the flat circuit body with the insertion guide portion positioned at the insertion completion position are substantially flush with each other.

5. The connector device according to claim 2, wherein the terminal pressing portion further comprises a stepped surface provided at a rear end of the straight surface in the insertion direction and between the straight surface and a bottom surface of the insertion guide portion, and the tip end of the flat circuit body is disposed to follow the stepped surface.

* * * * *